US010709912B2

(12) United States Patent
Lee

(10) Patent No.: US 10,709,912 B2
(45) Date of Patent: Jul. 14, 2020

(54) NASAL CAVITY INSERTION TYPE MASK

(71) Applicant: AirLab CO., Ltd., Jeonju-si, Jeollabuk-do (KR)

(72) Inventor: Hyo-Gwang Lee, Iksan-si (KR)

(73) Assignee: AirLab CO., Ltd., Jeonju-si, Jeollabuk-do (KR)

( * ) Notice: Subject to any disclaimer, the term of this patent is extended or adjusted under 35 U.S.C. 154(b) by 463 days.

(21) Appl. No.: 15/567,467

(22) PCT Filed: Dec. 8, 2015

(86) PCT No.: PCT/KR2015/013369

§ 371 (c)(1),
(2) Date: Oct. 18, 2017

(87) PCT Pub. No.: WO2017/003050

PCT Pub. Date: Jan. 5, 2017

(65) Prior Publication Data

US 2018/0104518 A1 Apr. 19, 2018

(30) Foreign Application Priority Data

Jul. 1, 2015 (KR) ..... 10-2015-0093857

(51) Int. Cl.
*A62B 23/06* (2006.01)

(52) U.S. Cl.
CPC ..... *A62B 23/06* (2013.01)

(58) Field of Classification Search
CPC ..... A62B 23/06; A62B 23/02; A62B 23/00; A61M 2210/0618; A61B 17/1688; A61B 2018/00327; A61F 2/18; A61F 2/02; A61F 2/00; A61F 2002/30304; A61F 5/56; A61F 5/08; A61F 5/05891
See application file for complete search history.

(56) References Cited

U.S. PATENT DOCUMENTS

2009/0120441 A1* 5/2009 Wang ..... A61M 15/08 128/206.11
2012/0204870 A1* 8/2012 McAuley ..... A61M 16/0616 128/203.12

FOREIGN PATENT DOCUMENTS

JP 2007-068598 A 3/2007
KR 20-0149401 Y1 6/1999
KR 20-0285213 Y1 8/2002
KR 20-0381526 Y1 4/2005
(Continued)

OTHER PUBLICATIONS

International Search Report issued in PCT/KR2015/013369; dated Mar. 28, 2015.

*Primary Examiner* — Tarla R Patel
(74) *Attorney, Agent, or Firm* — Studebaker & Brackett PC

(57) ABSTRACT

The present invention relates to a nasal cavity insertion type mask, and the purpose of the present invention is to provide a nasal cavity insertion type mask for filtering various kinds of fine dust contained in external air inhaled through the nose and preventing a respiratory disease by improving an antibacterial effect inside the nasal cavity, when the mask is inserted into the nose and breathing occurs, and the mask inserted into the nasal cavity is configured so as not to be separated from the naval cavity, and is configured to maintain filtering performance and enable an economical use thereof since only a filter can be replaced.

10 Claims, 6 Drawing Sheets

(56) References Cited

FOREIGN PATENT DOCUMENTS

| | | |
|---|---|---|
| KR | 10-1132000 B1 | 3/2012 |
| KR | 10-1479200 B1 | 1/2015 |

* cited by examiner

NASAL CAVITY INSERTION TYPE MASK

Cross Reference to Related Application

This application claims the priority of Korean Patent Application No. 10-2015-0093857, filed on Jul. 1, 2015 in the Korean Patent and Trademark Office. Further, this application is a National Phase application of International Application No. PCT/KR2015/013369 filed on Dec. 8, 2015, which is incorporated herein by reference in its entirety.

TECHNICAL FIELD

The present invention relates to a nasal cavity insertion type mask, and more particularly, to a nasal cavity insertion type mask that can filter various fine dust included in external air inhaled into a nose upon breathing by inserting into the nose and that can enhance health of a breathing organ by providing an antibacterial effect and a far infrared ray discharge effect.

BACKGROUND ART

In general, a mask having several forms and structures to prevent dust harmful to a human body, such as pollen, yellow dust, and a virus from being entered through a mouth or a nose has been used.

Nowadays, strong yellow dust blown from Chinese desert causes a breathing organ injury to children, the old and the weak, or persons working at the outside, and strong yellow dust containing a large amount of heavy metal limits outdoor activities of persons to have a bad influence on an economic activity performing at the outside.

Because a person in an environment of downtown having heavy pollution or strong yellow dust, for example, a person driving for much time in a downtown, a person working at the outside, and a person performing an agricultural pesticide spraying work are easily exposed to dust, pigment dust, agricultural pesticides, vehicle exhaust, yellow dust, and heavy metal in the air, in order to prevent such harmful materials from being entered into a body, the persons wear a predetermined mask.

However, a generally using conventional mask is provided in a form that covers both a nose and a mouth, and a mask produced in a form and size that disregard an external appearance gets attention of a peripheral person upon wearing and thus there is a problem that the persons avoid the mask from wearing, and as a mask fastening means, a hair band, an earring type string, or a sticking plaster has been used and thus there is inconvenience upon wearing the mask, and because a mouth is covered by the mask, there is a problem that it is difficult to communicate through talking in a state in which the mask is worn.

Further, when wearing such a conventional mask, concave portions of both sides of a nose are floated and thus dust, a foreign substance, and a virus may permeate through a gap thereof and thus the conventional mask may not be a perfect means for preventing dust, a foreign substance, and a virus.

An example of technology for solving such a problem is disclosed in Patent document 1.

In Patent document 1, a nasal cavity mask that can simply carry and that can quickly insert into a nose and inserted into a nostril to remove a virus and fine dust while enabling convenient breathing is provided, and the nasal cavity mask inserted into a nostril includes a first filter that gives sufficient permeability to primarily filter harmful air of the outside; a filtration portion including a filling material for removal and sterilization of a virus while absorbing fine dust and an organic matter included in air filtered by the first filter; and a second filter that finally filters a harmful component of air passed through the filtration portion to discharge the air into the nose.

However, in the above-described conventional art, because a mask is formed in a straight cylindrical capsule form, there is a problem that the mask is easily separated from a nose, and because both a plurality of filters and a filtration portion are formed with a filter and are sequentially connected, it is difficult to replace the plurality of filters and the filtration portion after using for a predetermined time and thus there is a problem that the mask is discarded after using one time.

PRIOR ART DOCUMENT

Patent Document (Patent document 1) Korean Patent Publication No. 1132000 (registered on Mar. 23, 2012)

DISCLOSURE

Technical Problem

The present invention has been made in view of the above problems and provides a nasal cavity insertion type mask inserted into a nose to filter various fine dust included in external air inhaled into the nose upon breathing and that prevents respiratory organ disease by increasing an antibacterial effect within a nasal cavity and that is configured to prevent the mask from being easily separated from the inside of the nasal cavity and that can replace only a foreign substance filter coupled to a housing to maintain a filter performance and to enable economical use.

Technical Solution

In accordance with an aspect of the present invention, a nasal cavity insertion type mask inserted into a nose to filter external air inhaled upon breathing includes a body formed in a cone shape having a gradually reducing diameter in an upward direction in order to deeply insert into a nasal cavity and formed in a form in which an upper portion, a lower portion, and a side surface are opened for smooth communication of air; a filter detachably provided at an outer surface of the body and that filters a foreign substance included in external air; and a fixing tube that comes in close contact a portion of the filter with the body and that fixes a portion of the filter to the body in order to prevent the filter disposed to enclose an outer surface of the body from being separated from the body and that includes a double wall configuration including an inner wall and an outer wall and a snot receiving portion that can receive a snot flowing along a nasal cavity inner wall.

Further, the body may include a support lower portion having the inside formed in a cylindrical shape in which an air communicating hole is vertically penetrated for smooth communication of air and having the outside having a coupling groove at a circumference in order to binding support the fixing tube; a support upper portion formed at a position separated by a predetermined distance in an upward direction from the support lower portion and formed in a ring shape having the penetrated center; and at least one connection bar that connects the support lower portion and the support upper portion to support each configuration.

Further, the support upper portion of the body may have a diameter smaller than that of the support lower portion.

Further, the filter may be formed with a combination of cottonseed and a traditional Korean paper thread.

Further, the filter may be configured with a first fiber produced using traditional Korean paper as a main component by mixing traditional Korean paper produced using the paper mulberry as a main raw material and natural cotton wool with 7:3 wt % and a second fiber formed through a process of soaking natural cottonseed produced with natural cotton wool in antibacterial water and drying the natural cottonseed, the filter may be formed by weaving processing the first fiber and the second fiber, and the weaving processed first fiber and second fiber may be formed with 5:5 wt %.

Further, the fixing tube may include a coupling through-hole having a vertically penetrated central portion to be insertion coupled to the body; an inner wall that comes in close contact the filter inserted into the outside of the body with the body and that fixes the filter to the body; an outer wall that comes in close contact with a skin within the nasal cavity and that is fixed to the skin to prevent the mask from being separated from the nose; and a snot receiving portion that forms a separated space between the inner wall and the outer wall and having a lower portion that forms a space portion of a blocked 'U'-shaped cross-section.

Further, the outer wall may be formed higher than the inner wall to prevent a snot of the nasal cavity inner wall from contacting the filter.

Further, at an inner side surface of the inner wall facing the coupling through-hole, a coupling protruding portion formed in a curved shape may be protruded in a direction of the coupling through-hole to correspond to a shape of a coupling groove of the body.

Further, at least one of the body and the fixing tube may be formed with a mixture of silicon and the functional composition.

Further, at least one of the body and the fixing tube may include silicon 93-96 wt %, hardener 1-3 wt %, and a functional composition 2-5 wt %, and a grain of the functional composition may be minutely crushed in a size of a range of 200-1000 meshes.

Further, the functional composition may include at least one of silver (Ag), gold (Au), germanium (Ge), charcoal, elvan, sericite, activated carbon, jade, and magnet. The functional composition may include at least one of silver (Ag), gold (Au), germanium (Ge), charcoal, elvan, sericite, activated carbon, jade, and magnet.

Further, the antibacterial water may include any one of purple bamboo salt water in which purple bamboo salt is diluted in water, phytoncide undiluted solution, and purple bamboo salt diluted in phytoncide undiluted solution.

Further, the antibacterial water may be a mixture in which purple bamboo salt is melted in phytoncide undiluted solution with the purple bamboo salt 40-60wt % and the phytoncide undiluted solution 40-60 wt % in an entire mixture 100 wt %.

Advantageous Effects

As described above, a nasal cavity insertion type mask according to the present invention purifies various viruses and fine dust included in external air inhaled into a nose to prevent respiratory organ disease and to prevent the mask from being easily separated from a nose, thereby enhancing a wearing performance.

Further, when a filter function of a nasal cavity insertion type mask according to the present invention is lost, the nasal cavity insertion type mask is configured to enable a user to easily replace a filter and thus a body and a fixing tube can be reused, and because the user can easily replace the filter at a desired time point, an air filter function can be continuously maintained.

Further, because various functional compositions are contained in the body and the fixing tube, virus proliferation is prevented through an antibacterial effect and blood circulation is promoted by a cell activity effect through far infrared ray discharge and health of a breathing organ can be enhanced.

Further, a physiology operation (e.g., temperature, humidity, filter) of the inside of a nasal cavity is adjusted by a filter using cottonseed, which is natural fiber and a traditional Korean paper thread as a material, and particularly, a heat effect of inhaled air in a winter season is obtained and moisture is adjusted and thus health of a breathing organ can be enhanced.

DESCRIPTION OF REFERENCE NUMERALS INDICATING PRIMARY ELEMENTS IN THE DRAWINGS

Figure 1:
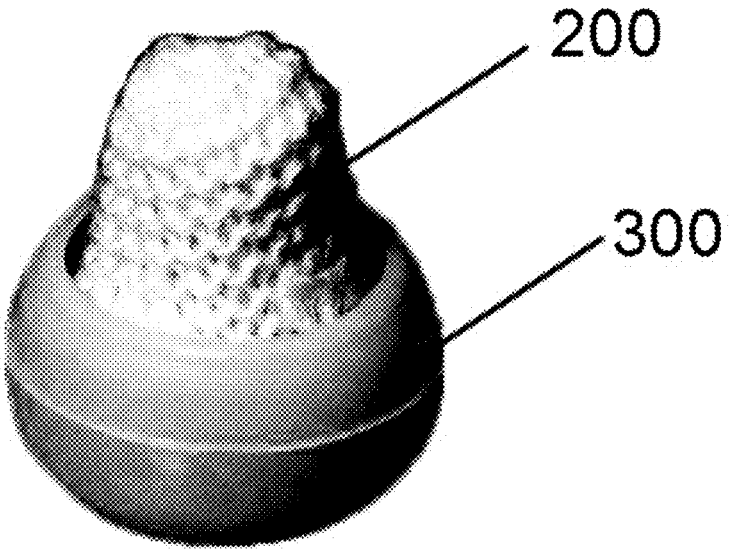
FIG. 1 is a perspective view illustrating an entire configuration of a nasal cavity insertion type mask according to an exemplary embodiment of the present invention.

100: body 110: support lower portion
111: coupling groove 112: air communicating hole
120: support upper portion 130: connection bar
200: filter 300: fixing tube
310: coupling through-hole 320: inner wall
321: coupling protruding portion 330: outer wall
340: snot receiving portion

BEST MODE

A nasal cavity insertion type mask according to an exemplary embodiment of the present invention includes a body formed in a cone shape having a gradually reducing diameter in an upward direction in order to deeply insert into a nasal cavity and formed in a form in which an upper portion, a lower portion, and a side surface are opened for smooth communication of air; a filter detachably provided at an outer surface of the body and that filters a foreign substance included in external air; and a fixing tube that comes in close contact a portion of the filter with the body and that fixes a portion of the filter to the body in order to prevent the filter disposed to enclose an outer surface of the body from being separated from the body and that includes a double wall configuration including an inner wall and an outer wall and a snot receiving portion that can receive a snot flowing along the nasal cavity inner wall.

The filter may be formed with a combination of cottonseed and a traditional Korean paper thread.

At least one of the body and the fixing tube may be formed with a mixture of silicon and the functional composition, and the functional composition may include at least one of silver (Ag), gold (Au), germanium (Ge), charcoal, elvan, sericite, activated carbon, jade, and magnet.

Hereinafter, an exemplary embodiment of the present invention will be described in detail with reference to the accompanying drawings.

Figure 2:
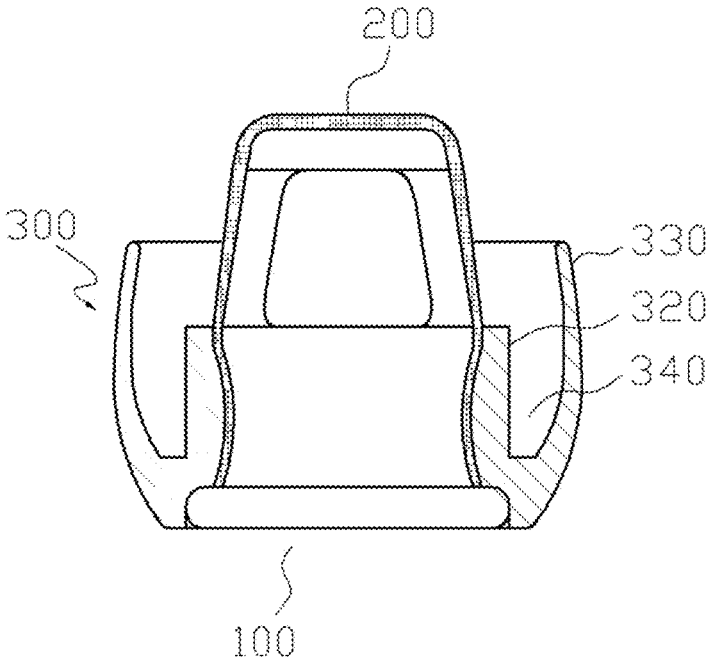
FIG. 2 is a cross-sectional view illustrating an entire configuration of a nasal cavity insertion type mask according to an exemplary embodiment of the present invention assembly.
Figure 3:
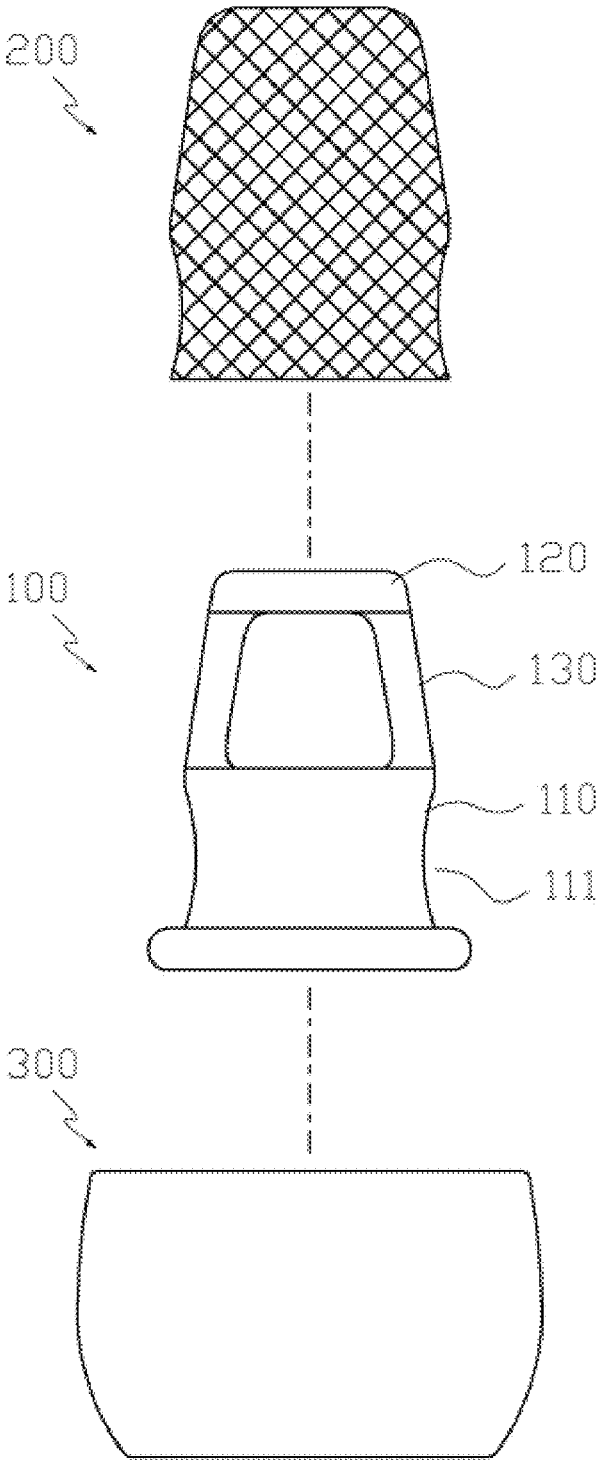
FIG. 3 is an exploded view of each configuration of a nasal cavity insertion type mask according to an exemplary embodiment of the present invention.
Figure 4:
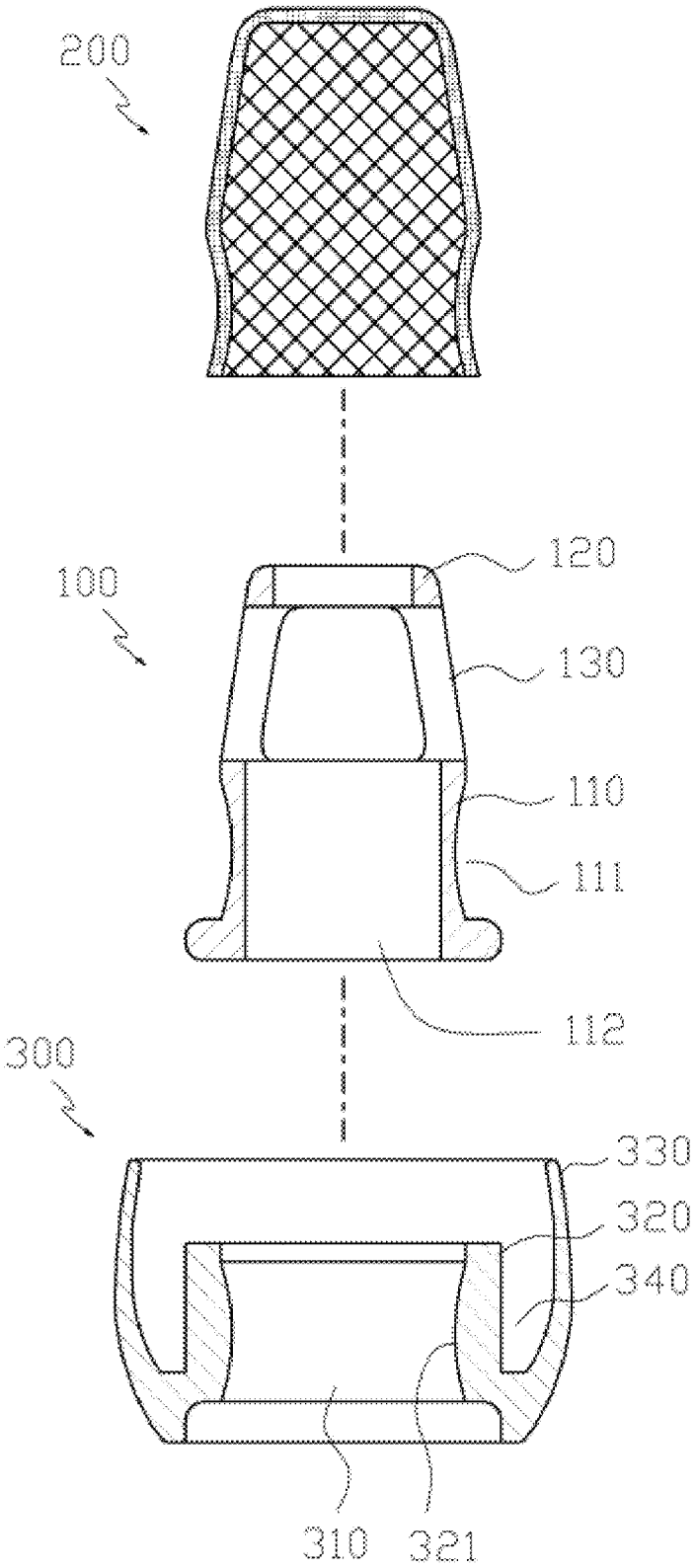
FIG. 4 is an exploded cross-sectional view of each configuration of a nasal cavity insertion type mask according to an exemplary embodiment of the present invention.
Figure 5:
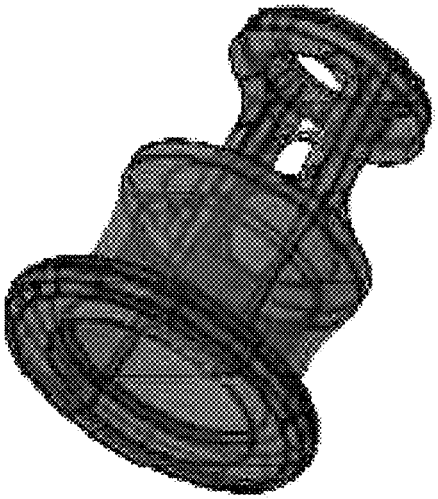
FIG. 5 is a perspective view illustrating a body of a nasal cavity insertion type mask according to an exemplary embodiment of the present invention.
Figure 6:
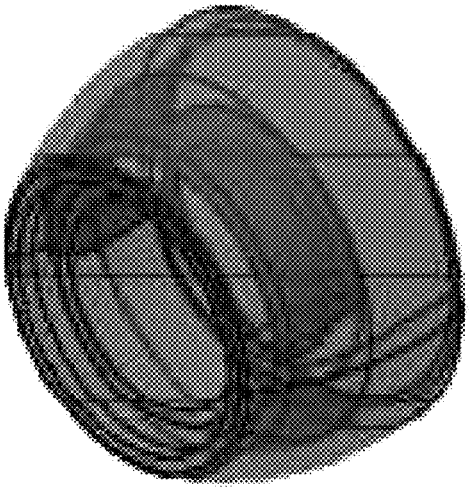
FIG. 6 is a perspective view illustrating a fixing tube of a nasal cavity insertion type mask according to an exemplary embodiment of the present invention.
Figure 7:
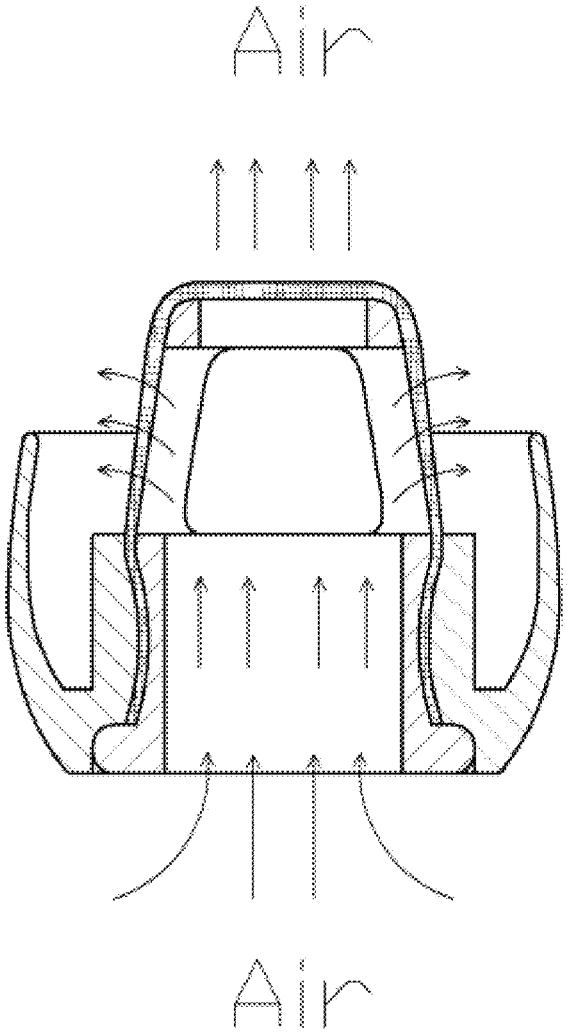
FIG. 7 is a use state diagram illustrating air flow in a nasal cavity insertion type mask according to an exemplary embodiment of the present invention.
Figure 8:
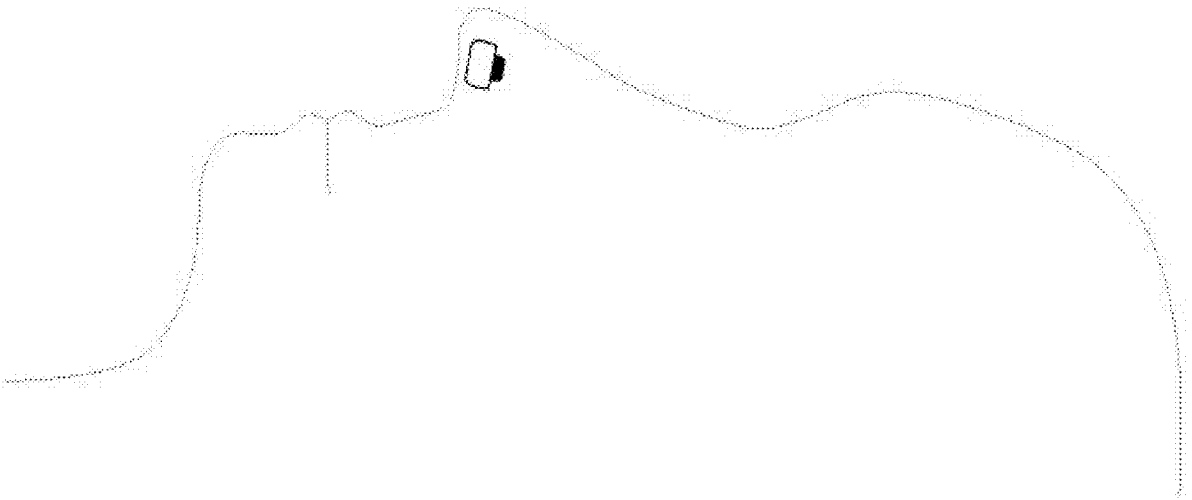
FIG. 8 is a use state diagram illustrating a wearing state of a nasal cavity insertion type mask according to an exemplary embodiment of the present invention.

FIGS. 1 to 6 illustrate a nasal cavity insertion type mask according to an exemplary embodiment of the present invention, FIGS. 1 and 2 illustrate an entire assembly configuration of a nasal cavity insertion type mask, FIGS. 3 and 4 illustrate a separated configuration of a nasal cavity insertion type mask, FIG. 5 illustrates a body shape in a nasal cavity insertion type mask, and FIG. 6 illustrates a shape of a fixing tube in a nasal cavity insertion type mask.

As shown in FIGS. 1 to 6, a nasal cavity insertion type mask according to an exemplary embodiment of the present invention is inserted into a nose to filter external air inhaled upon breathing and includes a body 100, a filter 200, and a fixing tube 300.

The body 100 maintains a form of the filter 200 inserted into a nasal cavity, is used for binding the fixing tube 300, is formed in a form in which the entire of the upper end, the lower end, and a side surface is opened to have a configuration characteristic that enhances air communication efficiency, and includes a support lower portion 110, a support upper portion 120, and a connection bar 130.

The support lower portion 110 is positioned at a lower portion of the body 100, the inside thereof is formed in a cylindrical shape in which an air communicating hole 112 for smooth communication of air is vertically penetrated, and in order to binding support the fixing tube 300, a coupling groove 111 is formed at a circumference of the outside thereof.

The support upper portion 120 is positioned at an upper portion of the body 100, is formed in a ring shape having the penetrated center for smooth communication of air, is formed at a position separated by a predetermined distance in an upward direction from the support lower portion 110, and this enables smooth communication of air in a side direction.

The connection bar 130 connects the support lower portion 110 and the support upper portion 120 to support each configuration, at least one connection bar 130 may be used, and it is preferable that at each end portion connected to the support lower portion 110 and the support upper portion 120, a reinforcement portion for durability enhancement is further formed.

Further, the support upper portion 120 is formed to have a diameter smaller than that of the support lower portion 110 and an entire shape of the body 100 has a cone shape having a gradually reducing diameter toward an upper portion and this may enable to be deeply inserted into a nasal cavity, and when the nasal cavity mask is inserted in consideration of an internal structure of the nasal cavity, the cone shape is a shape for enhancing a wearing feeling and is configured to easily perform a process of separating the nasal cavity mask inserted into the nasal cavity.

The body 100 formed in the above shape is made of a synthetic resin and is preferably made of a silicon material in consideration of a wearing feeling within the nasal cavity.

Further, the body 100 includes a functional composition that enhances an antibacteria effect and having far infrared ray and negative ion discharge effects and a blood circulation promotion effect, and such a functional composition may include at least one of silver (Ag), gold (Au), germanium (Ge), charcoal, elvan, sericite, activated carbon, jade, and magnet. It has been known that charcoal, elvan, sericite, activated carbon, and jade have deodorization and humidity adjustment effects in addition to blood circulation, cell activity promotion, and antibacterial functions according to discharge of far infrared rays.

The magnet may absorb a portion of micro metal dust floating in the air at various kinds of industrial sites through magnetism in addition to a blood circulation promotion function.

Compositions constituting the body 100 include silicon 93-96 wt %, hardener 1-3 wt %, and a functional composition 2-5 wt % in an entire composition 100 wt %, and it is preferable that a grain of the functional composition is applied in a minutely crushed form in a size of a range of 200-1000 meshes.

In this case, when silicon is contained with less than 93 wt % or when a functional composition is contained to exceed 5 wt %, an elastic force of the shaped body 100 is deteriorated and thus a wearing feeling is not good, and a bonding force to the functional composition is deteriorated and thus there is a problem that a crack occurs in a product or that a product shaping performance is not good.

However, when silicon is contained to exceed 96 wt %, a content of a functional composition is relatively less, and when silicon is contained to exceed 96 wt % or when a functional composition is contained with less than 2 wt %, antibacterial and far infrared ray discharge effects according to a functional composition are deteriorated and it is not good.

Further, a grain size of a functional composition is less than 200 meshes, a particle is thick and thus a wearing feeling is not comfortable and there is a problem that a crack may occur in a product or that a shaping performance is not good, and if a grain size of a functional composition exceeds 1000 meshes, it is difficult to perform a crush process and thus there is a problem that product productivity is deteriorated.

The filter 200 is detachably provided at an outer surface of the body 100 to perform a function of filtering a harmful material included in external air. Particularly, when a filter function of a filter is lost, the filter 200 is configured such that a user easily replaces the filter 200 and thus the body 100 and the fixing tube 300 may be reused, and the filter 200 may be easily replaced at a time point in which the user wants and thus an air purification function may be continuously maintained.

Because the filter 200 is provided at the outside of the body 100, it is preferable that the filter 200 is formed in a form similar to that of the body 100.

The filter 200 is formed with a combination of cottonseed, which is a natural fiber and a traditional Korean paper thread formed with a thread of a fiber form formed with Korean paper produced using the paper mulberry as a main component, and the traditional Korean paper thread has excellent antibiosis, has a good air penetration ratio, has a high far infrared ray emission rate and a deodorization effect according to a porous structure, and has a fast dry performance.

More specifically, the filter 200 according to an exemplary embodiment of the present invention is a configuration with a first fiber (traditional Korean paper thread) produced using traditional Korean paper as a main component by mixing traditional Korean paper produced using the paper mulberry as a main raw material and natural cotton wool with 7:3 wt % and a second fiber formed through a process of soaking natural cottonseed produced with natural cotton wool in antibacterial water and drying the natural cottonseed, and the filter 200 is formed by weaving processing the first fiber and the second fiber. In this case, it is preferable that the weaving processed first fiber and second fiber are formed with 5:5 wt %.

The antibacterial water may include any one of purple bamboo salt water in which purple bamboo salt is diluted in water, a phytoncide undiluted solution, and purple bamboo salt diluted in a phytoncide undiluted solution.

The purple bamboo salt is bamboo salt formed to represent a purple color through a process of baking nine times sun-dried salt and bamboo at a high temperature, and it is known that the purple bamboo salt performs an excellent antibacterial operation and is good in other anti-inflammation operation and blood circulation promotion. It is preferable that a saturation solution of the purple bamboo salt water used in the present invention is formed and used by diluting the purple bamboo salt in water.

Phytoncide is a material in which plants spout or discharge in order to resist a medical facility virus, a harmful insect, and mold, and when a person inhales phytoncide through woodland walks, it is known that the phytoncide enables his stress to be released and performs a sterilization operation. Phytoncide used in the present invention may be an extract that extracts only a phytoncide component from plants or a phytoncide extract available at a market.

Further, when the purple bamboo salt and the phytoncide undiluted solution are mixed and used, a mixture is used in which purple bamboo salt is melted in phytoncide undiluted solution with the purple bamboo salt 40-60wt % and the phytoncide undiluted solution 40-60 wt % in an entire mixture 100 wt %.

In an entire mixture 100 wt %, when purple bamboo salt is mixed with less than 40 wt % or when phytoncide undiluted solution is mixed to exceed 60 wt %, an effect of the purple bamboo salt slightly operates and thus it is unpreferable, and in an entire mixture 100 wt %, when purple bamboo salt is mixed to exceed 60 wt % or when phytoncide undiluted solution is mixed with less than 40wt %, a dilution amount in which the purple bamboo salt is mixed in the phytoncide undiluted solution exceeds a saturation state and thus it is unpreferable.

A first fiber of the filter 200 is configured with a combination of traditional Korean paper and natural cotton wool, but when traditional Korean paper is contained less than the processing condition, various effects of a traditional Korean paper thread having traditional Korean paper as a main component become slight and the entire filter 200 is maintained in a flexible form and thus there is problem that it is difficult to maintain a shape of the filter 200. However, when traditional Korean paper is contained more than the processing condition, the filter 200 becomes hard and thus there is problem that a wearing feeling is deteriorated and that a surface of the filter 200 is rough.

The filter 200 produced with the foregoing method may perform an antibacterial operation and be formed with a combination of a traditional Korean paper thread and cottonseed to adjust a physiology operation (e.g., temperature, humidity, filter) within a nose, and particularly, the filter 200 may have a heat effect of inhaled air in a winter season and adjust moisture to enhance nose health.

The fixing tube 300 is coupled to an outer surface of the body 100 to enable the filter 200 to come in close contact with the body 100 and to fix the filter 200 to the body 100 such that the filter 200 is not separated from the body 100, and the fixing tube 300 comes in close contact with a skin within the nasal cavity to prevent a nasal cavity insertion type mask according to an exemplary embodiment of the present invention from being separated to the outside and enables to separate the filter 200 from a skin within the nasal cavity to prevent the filter 200 from being wet by a snot and to separately receive the snot.

An entire shape of the fixing tube 300 is formed in a ring type, and the fixing tube 300 includes a coupling through-hole 310, an inner wall 320, an outer wall 330, and a snot receiving portion 340.

Because a central portion of the coupling through-hole 310 is vertically penetrated, the coupling through-hole 310 may be inserted and coupled to the body 100.

The inner wall 320 is a configuration for coming in close contact the filter 200 inserted into the outside of the body 100 with the body 100 and fixing the filter 200 to the body 100, and at an inner side surface of the inner wall 320 facing the coupling through-hole 310, a coupling protruding portion 321 formed in a curved shape is protruded in a direction of the coupling through-hole 310 to correspond to a shape of a coupling groove 111 of the body 100.

The outer wall 330 comes in close contact with a skin within the nasal cavity and is fixed to a skin within the nasal cavity to prevent the nasal cavity insertion type mask from being separated from the nasal cavity, is formed higher than the inner wall 320 to prevent moisture such as a snot within the nasal cavity from contacting the filter 200, thereby maintaining a filter performance of the filter 200.

In order to prevent the filter 200 from being wet with a snot flowing along a wall within the nasal cavity to prevent a filter performance from being deteriorated, the snot receiving portion 340 forms a separate space portion that can receive a flowing snot and forms a separated space between the inner wall 320 and the outer wall 330, and a lower portion thereof forms a space portion of a blocked 'U'-shaped cross-section. Further, the snot receiving portion 340 is a configuration formed when the inner wall 320 and the outer wall 330 form a separated space and provides a space in which the outer wall 330 may be extended and reduced to the inside, and such a configuration enables the outer wall 330 to be extended and reduced to correspond to different nasal cavity sizes according to a user.

It is preferable that the fixing tube 300 having the above shape is made of a silicon material in consideration of a wearing feeling.

Further, the fixing tube 300 includes a functional composition that enhances an antibacteria effect and having far infrared ray and negative ion discharge effects and a blood circulation promotion effect, and such a functional composition may include at least one of silver (Ag), gold (Au), germanium (Ge), charcoal, elvan, sericite, activated carbon, and jade. It has been known that charcoal, elvan, sericite, activated carbon, and jade have deodorization and humidity adjustment effects in addition to blood circulation and cell activity promotion and antibacterial functions according to far infrared ray discharge.

Compositions constituting the fixing tube 300 include silicon 93-96 wt %, hardener 1-3 wt %, and a functional composition 2-5 wt % in an entire composition 100 wt %, and it is preferable that a grain of the functional composition is minutely crushed in a size of a range of 200-1000 meshes.

In this case, when silicon is contained with less than 93 wt % or when a functional composition is contained to exceed 5 wt %, an elastic force of the shaped fixing tube 300 is deteriorated and thus a wearing feeling is not good, and a bonding force to the functional composition is deteriorated and thus there is a problem that a crack occurs in a product or that a product shaping performance is not good.

However, when silicon is contained to exceed 96 wt %, a content of a functional composition is relatively less, and when silicon is contained to exceed 96 wt % or when a functional composition is contained with less than 2 wt %, antibacterial and far infrared ray discharge effects according to a functional composition are deteriorated and it is not good.

Further, when a grain size of a functional composition is less than 200 meshes, a particle is thick and thus a wearing feeling is not comfortable and there is a problem that a crack may occur in a product or that a shaping performance is not good, and when a grain size of a functional composition exceeds 1000 meshes, it is difficult to perform a crush process and thus there is a problem that product productivity is deteriorated.

Exemplary Embodiment: Production of Mixed Filter of Traditional Korean Paper Thread and Cottonseed First step: a first fiber (traditional Korean paper thread) was formed using traditional Korean paper as a main component by mixing the traditional Korean paper produced using the paper mulberry as a main component and natural cotton wool with 7:3 wt %.

Second step: antibacterial water produced by mixing purple bamboo salt 50 wt % and phytoncide undiluted solution 50 wt % was prepared.

Third step: natural cottonseed produced using natural cotton wool was prepared, was soaked in antibacterial water prepared at the second step, and was dried, thereby forming a second fiber.

Fourth step: by weaving the first fiber and the second fiber produced at the foregoing steps, a filter having a fiber thickness of 0.4-0.8 mm and a through-hole size of 300-600 mesh was produced.

COMPARATIVE EXAMPLE 1

Synthetic Resin Filter

The synthetic resin filter is a filter for a mask already available at a market and is produced using a synthetic resin (PE, PP) as a main raw material, and a filter having a through-hole size of 300-600 meshes was prepared.

COMPARATIVE EXAMPLE 2

Non-Woven Fabric Filter

The non-woven fabric filter is a filter for a mask already available at a market, was produced using an antibacterial processed non-woven fabric as a main raw material, and a filter having a through-hole size of 300-600 meshes was prepared.

EXPERIMENTAL EXAMPLE 1

When an air permeability experiment was performed using a mixed filter of cottonseed and a traditional Korean paper thread produced through an exemplary embodiment of the present invention, a synthetic resin filter of Comparative Example 1, and a non-woven fabric filter of Comparative Example 2, the following result was obtained. In this case, in the exemplary embodiment, Comparative Example 1, and Comparative Example 2, through-hole sizes of the filter are the same and thus a filter performance of fine dust was excluded from an experiment target.

TABLE 1

| Target | Air permeability |
|---|---|
| Exemplary embodiment: mixed filter of traditional Korean paper and cottonseed | 50.47 cm/s |
| Comparative Example 1: synthetic resin filter | 19.03 cm/s |
| Comparative Example 2: non-woven fabric filter | 12.93 cm/s |

EXPERIMENTAL EXAMPLE 2

When an antibiosis experiment was performed using a mixed filter of cottonseed and a traditional Korean paper thread produced through an exemplary embodiment of the present invention, a synthetic resin filter of Comparative Example 1, and a non-woven fabric filter of Comparative Example 2, the following result was obtained.

TABLE 2

| Test item | | Test result | | |
|---|---|---|---|---|
| | | Initial concentration (CFU/mL) | Concentration after 24 hours (CFU/mL) | Bacteria reduction rate (%) |
| Antibacterial test by *colon bacillus* | Exemplary embodiment | $1.7 \times 10^4$ | <10 | 99.9 |
| | Comparative Example 1 | $1.7 \times 10^4$ | $5.5 \times 10^4$ | — |
| | Comparative Example 2 | $1.7 \times 10^4$ | $1.7 \times 10^4$ | — |
| Antibacterial test by *Bacillus pyocyaneus* | Exemplary embodiment | $2.0 \times 10^4$ | <10 | 99.9 |
| | Comparative Example 1 | $2.0 \times 10^4$ | $5.9 \times 10^4$ | — |
| | Comparative Example 2 | $2.0 \times 10^4$ | $1.1 \times 10^4$ | — |
| Antibacterial test by *Staphylococcus aureus* | Exemplary embodiment | $1.2 \times 10^4$ | <10 | 99.9 |
| | Comparative Example 1 | $1.2 \times 10^4$ | $4.6 \times 10^4$ | — |
| | Comparative Example 2 | $1.2 \times 10^4$ | $1.2 \times 10^4$ | — |
| Antibacterial test by MASA *bacillus* | Exemplary embodiment | $1.1 \times 10^4$ | <10 | 99.9 |
| | Comparative Example 1 | $1.1 \times 10^4$ | $4.3 \times 10^4$ | — |
| | Comparative Example 2 | $1.1 \times 10^4$ | $1.1 \times 10^4$ | — |

As described above, when a comparison experiment was performed with a mixed filter of cottonseed and a traditional Korean paper thread produced through an exemplary embodiment of the present invention, a filter available at a market of Comparative Example 1, and a filter available at a market of Comparative Example 2, while a fine dust filter performance is equally maintained, due to a material characteristic of the traditional Korean paper thread and the cottonseed, an air penetration ratio is remarkably high and thus it may be determined that a wearing feeling is good.

Further, in an antibacterial test of a filter performed with a filter produced through an exemplary embodiment of the present invention, a filter of Comparative Example 1, and a filter of Comparative Example 2, the filter produced through an exemplary embodiment of the present invention has a bacteria reduction rate of 99.9%, but other comparison filters have little bacteria reduction rate.

As can be determined through the experimental example 1 and the experimental example 2, it can be determined that a filter applied to a nasal cavity insertion type mask produced through the present invention provides a comfortable wearing feeling due to an excellent air penetration ratio and has very high antibiosis.

An exemplary embodiment of the present invention has been described in detail with reference to the drawings, but it will be apparent to those skilled in the art that various modifications and variations may be made in the present invention without departing from the spirit or scope of the invention. Therefore, the scope of the present invention should be analyzed by claims to include such many modifications and variations.

The invention claimed is:

1. A nasal cavity insertion type mask inserted into a nose to filter external air inhaled upon breathing, the nasal cavity insertion type mask, comprising:

a body formed in a cone shape having a gradually reducing diameter in an upward direction in order to deeply insert into a nasal cavity and formed in a form in which an upper portion, a lower portion, and a side surface are opened for smooth communication of air;

a filter detachably provided at an outer surface of the body and that filters a foreign substance included in external air; and a fixing tube that comes in close contact a portion of the filter with the body and that fixes a portion of the filter to the body in order to prevent the filter disposed to enclose an outer surface of the body from being separated from the body and that provides a double wall configuration comprising an inner wall and an outer wall and that prevents a snot of a nasal cavity inner wall from contacting the filter, as the outer wall is formed higher than the inner wall and comprising a snot receiving portion that can receive a snot flowing along the nasal cavity inner wall.

2. The nasal cavity insertion type mask of claim 1, wherein the body comprises:

a support lower portion positioned at a lower portion, having the inside formed in a cylindrical shape in which an air communicating hole is vertically penetrated for smooth communication of air, and having the outside having a coupling groove at a circumference in order to binding support the fixing tube;

a support upper portion formed at a position separated by a predetermined distance in an upward direction from the support lower portion and formed in a ring shape having the penetrated center; and at least one connection bar that connects the support lower portion and the support upper portion to support each configuration.

3. The nasal cavity insertion type mask of claim 2, wherein the support upper portion of the body has a diameter smaller than that of the support lower portion.

4. The nasal cavity insertion type mask of claim 1, wherein the fixing tube comprises:

a coupling through-hole having a vertically penetrated central portion to be insertion coupled to the body;

an inner wall that comes in close contact the filter inserted into the outside of the body with the body and that fixes the filter to the filter;

an outer wall that comes in close contact with a skin within the nasal cavity and that is fixed to the skin to prevent the mask from being separated from the nose; and a snot receiving portion that forms a separated space between the inner wall and the outer wall and having a lower portion that forms a space portion of a blocked 'U'-shaped cross-section.

5. The nasal cavity insertion type mask of claim 4, wherein at an inner side surface of the inner wall facing the coupling through-hole, a coupling protruding portion formed in a curved shape is protruded in a direction of the coupling through-hole to correspond to a shape of a coupling groove of the body.

6. A nasal cavity insertion type mask inserted into a nose to filter external air inhaled upon breathing, a body formed in a cone shape having a gradually reducing diameter in an upward direction in order to deeply insert into a nasal cavity and formed in a form in which an upper portion, lower portion, and a side surface are opened for smooth communication of air;

a filter detachably provided at an outer surface of the body to filter a foreign substance included in external air and formed with a combination of cottonseed and a traditional Korean paper thread; and a fixing tube that comes in close contact a portion of the filter to the body and that fixes a portion of the filter to the body in order to prevent the filter disposed to enclose an outer surface of the body from being separated from the body and comprising a double wall configuration comprising an inner wall and an outer wall and a snot receiving portion that can receive a snot flowing along the nasal cavity inner wall, wherein the filter is configured with a first fiber produced using traditional Korean paper as a main component by mixing traditional Korean paper produced using the paper mulberry as a main raw material and natural cotton wool with 7:3 wt% and a second fiber formed through a process of soaking natural cottonseed produced with natural cotton wool in antibacterial water and drying the natural cottonseed, the filter is formed by weaving processing the first fiber and the second fiber, and the weaving processed first fiber and second fiber are formed with 5:5 wt%.

7. The nasal cavity insertion type mask of claim 6, wherein the antibacterial water comprises any one of purple bamboo salt water in which purple bamboo salt is diluted in water, phytoncide undiluted solution, and purple bamboo salt diluted in phytoncide undiluted solution.

8. The nasal cavity insertion type mask of claim 7, wherein the antibacterial water is a mixture of purple bamboo salt and phytoncide undiluted solution and is a mixture in which purple bamboo salt is melted in phytoncide undiluted solution with purple bamboo salt 40-60 wt% and phytoncide undiluted solution 40-60 wt% in an entire mixture 100 wt%.

9. A nasal cavity insertion type mask inserted into a nose to filter external air inhaled upon breathing, the nasal cavity insertion type mask comprising:

a body formed in a cone shape having a gradually reducing diameter in an upward direction in order to deeply insert into a nasal cavity and formed in a form in which an upper portion, a lower portion, and a side surface are opened for smooth communication of air;

a filter detachably provided at an outer surface of the body and that filters a foreign substance included in external air; and a fixing tube that comes in close contact a portion of the filter with the body and that fixes a portion of the filter to the body in order to prevent the filter disposed to enclose an outer surface of the body from being separated from the body and that provides a double wall configuration comprising an inner wall and an outer wall and that prevents a snot of a nasal cavity inner wall from contacting the filter, as the outer wall is formed higher than the inner wall and comprising a snot receiving portion that can receive a snot flowing along a nasal cavity inner wall, wherein at least one of the body and the fixing tube is formed with a mixture of silicon and a functional composition, at least one of the body and the fixing tube comprises silicon 93-96 wt%, hardener 1-3 wt%, and a functional composition 2-5 wt%, and a grain of the functional composition is minutely crushed in a size of a range of 200-1000 meshes.

10. The nasal cavity insertion type mask of claim 9, wherein the functional composition comprises at least one of silver (Ag), gold (Au), germanium (Ge), charcoal, elvan, sericite, activated carbon, jade, and magnet.

* * * * *